US010506698B2

(12) United States Patent
Chang et al.

(10) Patent No.: US 10,506,698 B2
(45) Date of Patent: Dec. 10, 2019

(54) EUV SOURCE GENERATION METHOD AND RELATED SYSTEM

(71) Applicant: Taiwan Semiconductor Manufacturing Co., Ltd., Hsin-Chu (TW)

(72) Inventors: Chun-Lin Louis Chang, Hsinchu County (TW); Tzung-Chi Fu, Miaoli County (TW); Bo-Tsun Liu, Taipei (TW); Li-Jui Chen, Hsinchu (TW); Po-Chung Cheng, Chiayi County (TW); Wei-Ting Yi, Taichung (TW); Shang-Chieh Chien, New Taipei (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 0 days.

(21) Appl. No.: 15/949,543

(22) Filed: Apr. 10, 2018

(65) Prior Publication Data

US 2018/0317309 A1 Nov. 1, 2018

Related U.S. Application Data

(60) Provisional application No. 62/491,828, filed on Apr. 28, 2017.

(51) Int. Cl.
*H05G 2/00* (2006.01)

(52) U.S. Cl.
CPC ..... *H05G 2/008* (2013.01); *H05G 2/005* (2013.01)

(58) Field of Classification Search
CPC ..... H05G 2/00; H05G 2/001; H05G 2/003; H05G 2/005; H05G 2/006; H05G 2/008; G03F 7/70025; G03F 7/70033
See application file for complete search history.

(56) References Cited

U.S. PATENT DOCUMENTS

| | | | | |
|---|---|---|---|---|
| 8,764,995 | B2 | 7/2014 | Chang et al. | |
| 8,796,666 | B1 | 8/2014 | Huang et al. | |
| 8,828,625 | B2 | 9/2014 | Lu et al. | |
| 8,841,047 | B2 | 9/2014 | Yu et al. | |
| 8,877,409 | B2 | 11/2014 | Hsu et al. | |
| 9,093,530 | B2 | 4/2015 | Huang et al. | |
| 9,184,054 | B1 | 11/2015 | Huang et al. | |
| 9,256,123 | B2 | 2/2016 | Shih et al. | |
| 9,529,268 | B2 | 12/2016 | Chang et al. | |
| 9,548,303 | B2 | 1/2017 | Lee et al. | |
| 2010/0078579 | A1* | 4/2010 | Endo | H05G 2/001 250/504 R |

(Continued)

*Primary Examiner* — David E Smith
(74) *Attorney, Agent, or Firm* — Haynes and Boone, LLP

(57) ABSTRACT

A method and extreme ultraviolet (EUV) light source including a laser source configured to generate a first pre-pulse laser beam, a second pre-pulse laser beam, and a main pulse laser beam. In some embodiments, a droplet is irradiated within an extreme ultraviolet (EUV) vessel using the first pre-pulse laser beam to form a re-shaped droplet. In some examples, the droplet includes a tin droplet. In various embodiments, a seed plasma is then formed by irradiating the re-shaped droplet using the second pre-pulse laser beam. Thereafter, and in some cases, the seed plasma is heated by irradiating the seed plasma using the main pulse laser beam to generate EUV light.

20 Claims, 9 Drawing Sheets

(56) References Cited

U.S. PATENT DOCUMENTS

| | | | | |
|---|---|---|---|---|
| 2010/0171049 | A1* | 7/2010 | Moriya | H05G 2/003 250/504 R |
| 2012/0243566 | A1* | 9/2012 | Hori | H01S 3/10061 372/27 |
| 2016/0073487 | A1* | 3/2016 | Yanagida | H05G 2/006 250/504 R |
| 2016/0234920 | A1* | 8/2016 | Suzuki | H05G 2/003 |
| 2017/0171955 | A1* | 6/2017 | Ueno | H01L 21/027 |

* cited by examiner

EUV SOURCE GENERATION METHOD AND RELATED SYSTEM

CROSS-REFERENCE TO RELATED APPLICATION

This application claims the benefit of U.S. Provisional Application No. 62/491,828, filed Apr. 28, 2017, the entirety of which is incorporated by reference herein.

BACKGROUND

The electronics industry has experienced an ever increasing demand for smaller and faster electronic devices which are simultaneously able to support a greater number of increasingly complex and sophisticated functions. Accordingly, there is a continuing trend in the semiconductor industry to manufacture low-cost, high-performance, and low-power integrated circuits (ICs). Thus far these goals have been achieved in large part by scaling down semiconductor IC dimensions (e.g., minimum feature size) and thereby improving production efficiency and lowering associated costs. However, such scaling has also introduced increased complexity to the semiconductor manufacturing process. Thus, the realization of continued advances in semiconductor ICs and devices calls for similar advances in semiconductor manufacturing processes and technology.

As merely one example, semiconductor lithography processes may use lithographic templates (e.g., photomasks or reticles) to optically transfer patterns onto a substrate. Such a process may be accomplished, for example, by projection of a radiation source, through an intervening photomask or reticle, onto the substrate having a photosensitive material (e.g., photoresist) coating. The minimum feature size that may be patterned by way of such a lithography process is limited by the wavelength of the projected radiation source. In view of this, extreme ultraviolet (EUV) radiation sources and lithographic processes have been introduced. Today, EUV systems may use a laser produced plasma (LPP) EUV light source for EUV light generation. However, low conversion efficiency and EUV source power performance of such systems remain a critical challenge, and have a direct impact on cost per exposure and throughput, respectively. Thus, existing laser-produced-plasma EUV light generation sources have not proved entirely satisfactory in all respects.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
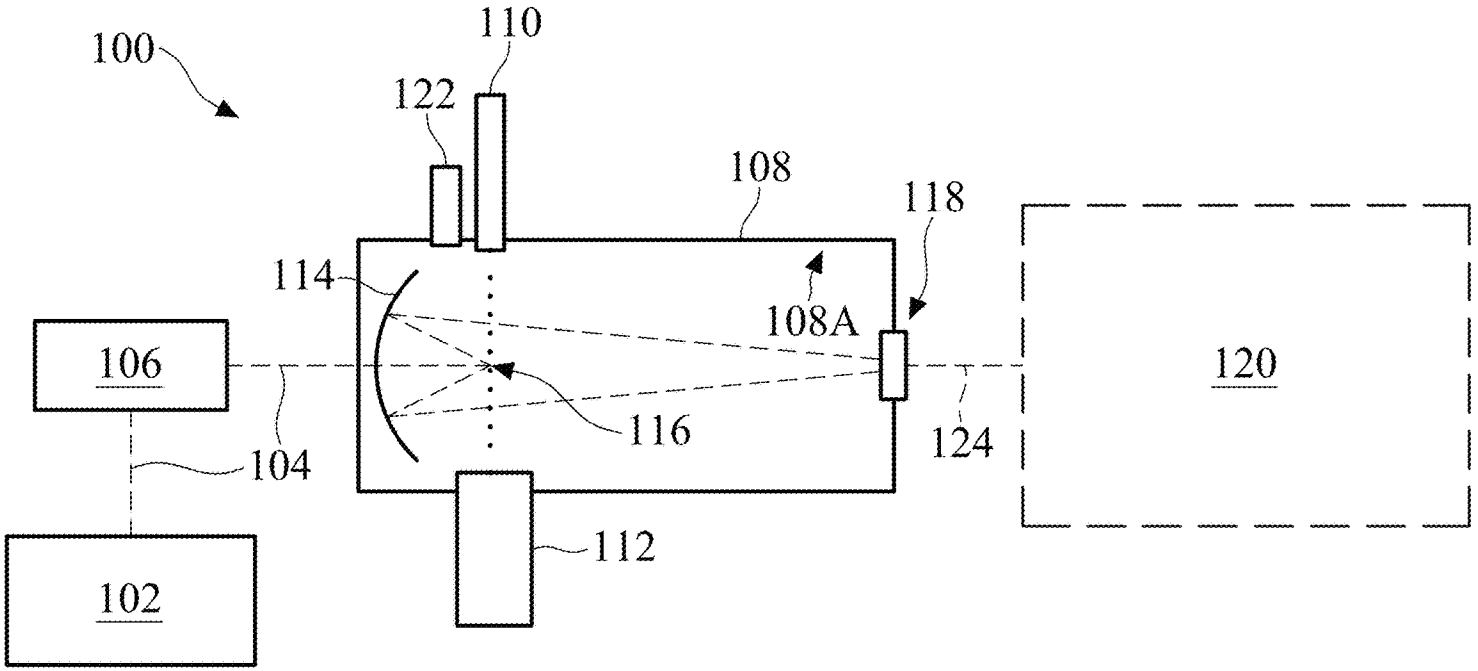
FIG. 1 is a schematic view of an EUV light source, including an exemplary EUV vessel, in accordance with some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly. Additionally, throughout the present disclosure, the terms "mask", "photomask", and "reticle" may be used interchangeably to refer to a lithographic template, such as an EUV mask. Also, throughout the disclosure, the terms "pre-pulse", "first pre-pulse", "second pre-pulse", and "main pulse" may at times be used interchangeably with the terms "pre-pulse laser beam", "first pre-pulse laser beam", "second pre-pulse laser beam", and "main pulse laser beam".

As the minimum feature size of semiconductor integrated circuits (ICs) has continued to shrink, there has continued to be a great interest in photolithography systems and processes using radiation sources with shorter wavelengths. In view of this, extreme ultraviolet (EUV) radiation sources, processes, and systems (e.g., such as the lithography system 800 discussed with reference to FIG. 8) have been introduced. Today, many EUV systems use a laser produced plasma (LPP) EUV light source for EUV light generation. However, low conversion efficiency and stable EUV source output power of such systems remain a critical challenge, and have a direct impact on throughput. Thus, improvement in conversion efficiency of laser-produced-plasma EUV light generation is key to scale up the stable EUV source output power with a limited laser input power. As a lithography light source, for example, benefits of increased conversion efficiency include increased wafer throughput with less tin contamination of the EUV light source vessel. In addition, the consumption of electrical power can be reduced to decrease operating costs. Generally, embodiments of the present disclosure provide an optical method of enhancing plasma heating for improving conversion efficiency of laser-produced-plasma (LPP) Extreme Ultraviolet (EUV) light generation with less tin contamination. For example, in some embodiments, improving the LPP EUV conversion efficiency and its stability by way of the methods disclosed herein may result in less tin contamination.

Referring to FIG. 1, illustrated therein is a schematic view of an EUV light source, including an exemplary EUV vessel. In some embodiments, an EUV light source 100 may include a laser produced plasma (LPP) EUV light source. Thus, as shown and in some embodiments, the EUV light source 100 may include a laser source 102 (e.g., such as a $CO_2$ laser) that generates a laser beam 104. The laser beam 104 may then be directed, by a beam transport and focusing system 106, to an EUV vessel 108. In various embodiments, the EUV vessel 108 also includes a droplet generator 110 and a droplet catcher 112. In some cases, the droplet generator 110 provides droplets of tin or a tin compound into the EUV vessel 108. In addition, the EUV vessel 108 may include one or more optical elements such as a collector 114. In some embodiments, the collector 114 may include a normal incidence reflector, for example, implemented as a multilayer mirror (MLM). For example, the collector 114 may include a silicon carbide (SiC) substrate coated with a Mo/Si multilayer. In some cases, one or more barrier layers may be formed at each interface of the MLM, for example, to block thermally-induced interlayer diffusion. In some examples, other substrate materials may be used for the collector 114 such as Al, Si, or other type of substrate materials. In some embodiments, the collector 114 includes an aperture through which the laser beam 104 may pass and irradiate droplets generated by the droplet generator 110, thereby producing a plasma at an irradiation region 116. By way of example, the laser beam 104 may irradiate the droplets using a double pulse scheme (e.g., as in some current systems) or a triple pulse scheme (e.g., in accordance with embodiments disclosed herein), as described in more detail below. In some embodiments, the collector 114 may have a first focus at the irradiation region 116 and a second focus at an intermediate focus region 118. By way of example, the plasma generated at the irradiation region 116 produces EUV light 124 collected by the collector 114 and output from the EUV vessel 108 through the intermediate focus region 118. From there, the EUV light 124 may be transmitted to an EUV lithography system 120 for processing of a semiconductor substrate (e.g., such as discussed with reference to FIG. 8). In some embodiments, the EUV vessel 108 may also include a metrology apparatus 122.

Figure 2:
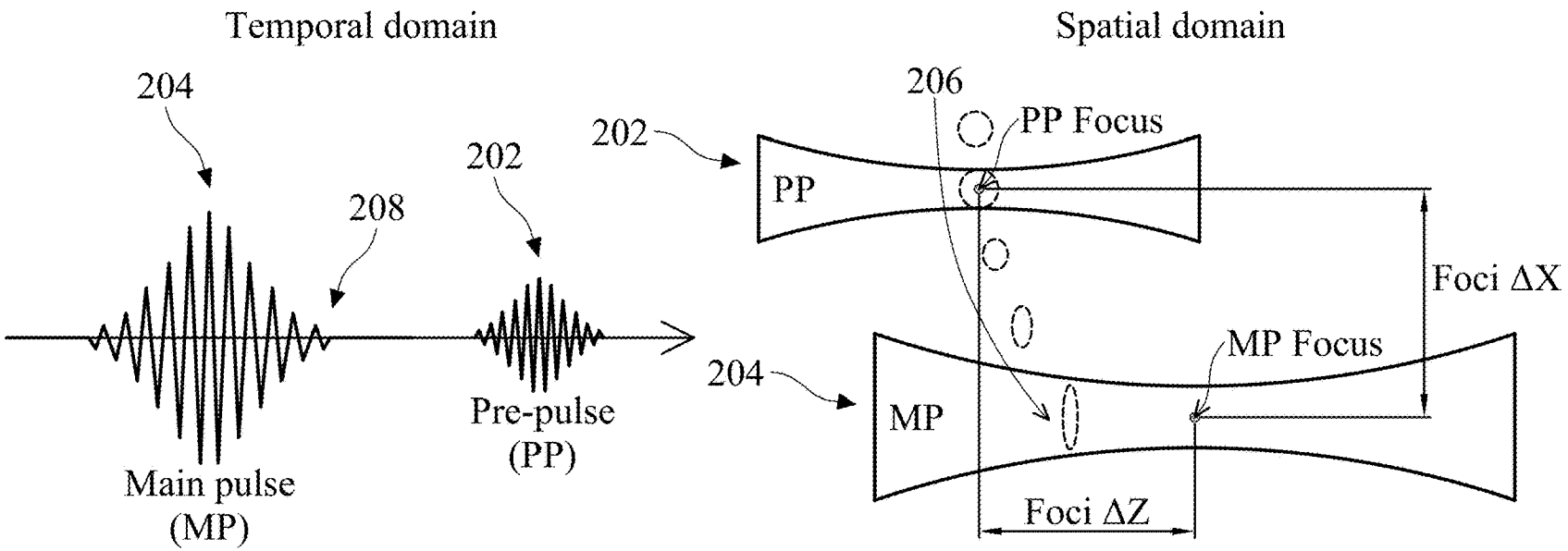
FIG. 2 is a schematic diagram of an exemplary double pulse scheme in both the temporal domain and the spatial domain.

As noted above, and in at least some current systems, a double pulse scheme is used to irradiate droplets generated by the droplet generator 110. With reference to FIG. 2, illustrated therein is a schematic diagram of an exemplary double pulse scheme in both the temporal domain and the spatial domain. Generally, a double pulse scheme involves using a pre-pulse (PP) 202 to re-shape the tin droplets generated by the droplet generator 110, and using a separate, main pulse (MP) 204 to produce a plasma and generate EUV light. In some cases, the pre-pulse 202 may have a duration of between about tens of picoseconds and hundreds of nanoseconds. In some examples, the time delay between the pre-pulse 202 and the main pulse 204 may be several microseconds (e.g., 3-4 microseconds), and the duration of the main pulse 204 may be about tens of nanoseconds. In various examples, the tin droplets generated by the droplet generator 110 may have size (e.g., diameter) of about tens of microns, while the focus spot size of the main pulse 204 laser beam may be quite a bit larger than the droplet diameter. By using the pre-pulse 202, the tin droplets can be re-shaped from a droplet to a disk, dome, cloud, or mist that has a similar size to, and that is better matched to, the focus spot size of the main pulse 204, thereby improving EUV conversion efficiency due to improved absorption of MP energy. Stated another way, the laser pre-pulse 202 is used to drive the falling tin droplet target to generate a mist of tin via thermodynamic evolution in several microseconds. The evolution of the tin droplet, in the spatial domain, is schematically illustrated in FIG. 2 by way of dashed circles/ovals along a path indicated by arrow 206. After re-shaping of the tin droplet by the pre-pulse 202, the main laser pulse (MP) 204 is used to interact with the mist of tin for EUV light generation. A mist of tin can improve the laser penetration into the tin target for more absorption or interaction, and with less reflection, thereby effectively improving the conversion efficiency.

In at least some current systems, and with respect to the main pulse 204, a front foot 208 of the main pulse may be used to form a preformed or seed plasma by optical ionization (e.g., multi-photon ionization). With a fixed delay determined by the duration of the main pulse 204, the preformed tin plasma is then heated by the main laser pulse 204 via inverse Bremsstrahlung absorption. In various examples, such plasma heating may include a feedback loop with collisional ionization and plasma expansion to result in a hot and dense tin plasma under collisional-radiation equilibrium (CRE). Finally, EUV emission is generated, for example, primarily via line emission. Among the challenges facing current methods and systems, the time delay between seed plasma formation (e.g., via multi-photon ionization) and plasma heating (e.g., via inverse Bremsstrahlung absorption) cannot be changed, for example, because only the main pulse is used for both functions (e.g., seed plasma formation and plasma heating). Thus, the initial preformed or seed plasma cannot be optimized by adjusting the time delay through hydrodynamic plasma evolution. Therefore, the efficiency of plasma heating as well as the conversion efficiency of LPP EUV generation cannot be further improved. The analytical equation of the inverse Bremsstrahlung absorption (IBA) coefficient ($k_{IB}$) is defined as $$k_{IB} = \frac{16\pi Z^2 n_e n_i e^6 \ln\Lambda(\nu)}{3c\nu^2(2\pi m_e k_B T_e)^{3/2}} \frac{1}{(1-\nu_p^2/\nu^2)^{1/2}}$$

where Z is the ionization state of ions, $n_e$ is the electron density, $n_i$ is the ion density, e is the electronic charge unit, c is the speed of light, v is the frequency of laser light ($w=2\pi v$), $m_e$ is the electron mass, $k_B$ is the Boltzmann constant, $T_e$ is the electron temperature, $v_p$ is the plasma frequency ($\omega_p=2\pi v_p$, $\ln \Lambda=\ln(v_T/\omega_p\ p_{min})$, where $v_T$ is the thermal velocity of electrons and $p_{min}\sim h/(m_e K_B T_e)^{1/2}$ where h is the Planck constant divided by $2\pi$. Based on the equation of the IBA given above, the efficiency of plasma heating depends on plasma density and temperature, and the initial condition is the transient spatiotemporal distribution of seed tin plasmas driven by the front foot of main laser pulse impinging on mist of tin. Thus, existing laser-produced-plasma EUV light generation sources have not proved entirely satisfactory in all respects.

Embodiments of the present disclosure offer advantages over the existing art, though it is understood that other embodiments may offer different advantages, not all advantages are necessarily discussed herein, and no particular advantage is required for all embodiments. For example, embodiments of the present disclosure provide a triple pulse scheme (e.g., provided as part of the EUV light source 100) that includes a first pre-pulse beam (e.g., which may be the pre-pulse beam described above), a second pre-pulse beam, and the main pulse. In some embodiments, the second pre-pulse is designed to be implemented between, in the time domain, the original pre-pulse and the main pulse. In various embodiments, the second pre-pulse may be used as a plasma igniter and the main pulse may be used as a plasma heater for creating a hot and dense plasma and for EUV generation. In some embodiments, the first pre-pulse may still be used to re-shape the tin droplets, as described above. In some examples, the time delay between the plasma igniter (e.g., the second pre-pulse) and the heater (e.g., the main pulse) may be adjusted to not only optimize the efficiency of plasma heating and EUV conversion efficiency but also to provide a larger operating window for high stability. By way of example, in some cases the time delay between the second pre-pulse and the main pulse may be between about 10-100 ns (e.g., when the drive laser wavelength is near about 1 micrometer). The longer the wavelength, the longer the time delay. In some embodiments, a longer laser wavelength may be used for the plasma heater (e.g., the main pulse) of which a pedestal of a leading-edge portion of the pulse is clean enough (e.g., such as a 1.064 μm wavelength, a 10.59 μm wavelength, or a greater wavelength of a high power $CO_2$ laser), and a shorter laser wavelength may be used for the plasma igniter (e.g., the second pre-pulse), such as about a 257 nm wavelength solid-state laser via harmonic generation. In some cases, the plasma igniter has a wavelength less than 257 nm. In some embodiments, the pulse duration of the plasma igniter (e.g., the second pre-pulse) may be short (e.g., within a picosecond-femtosecond range) for optical field ionization with high intensity (e.g., tunneling ionization).

Figure 3:
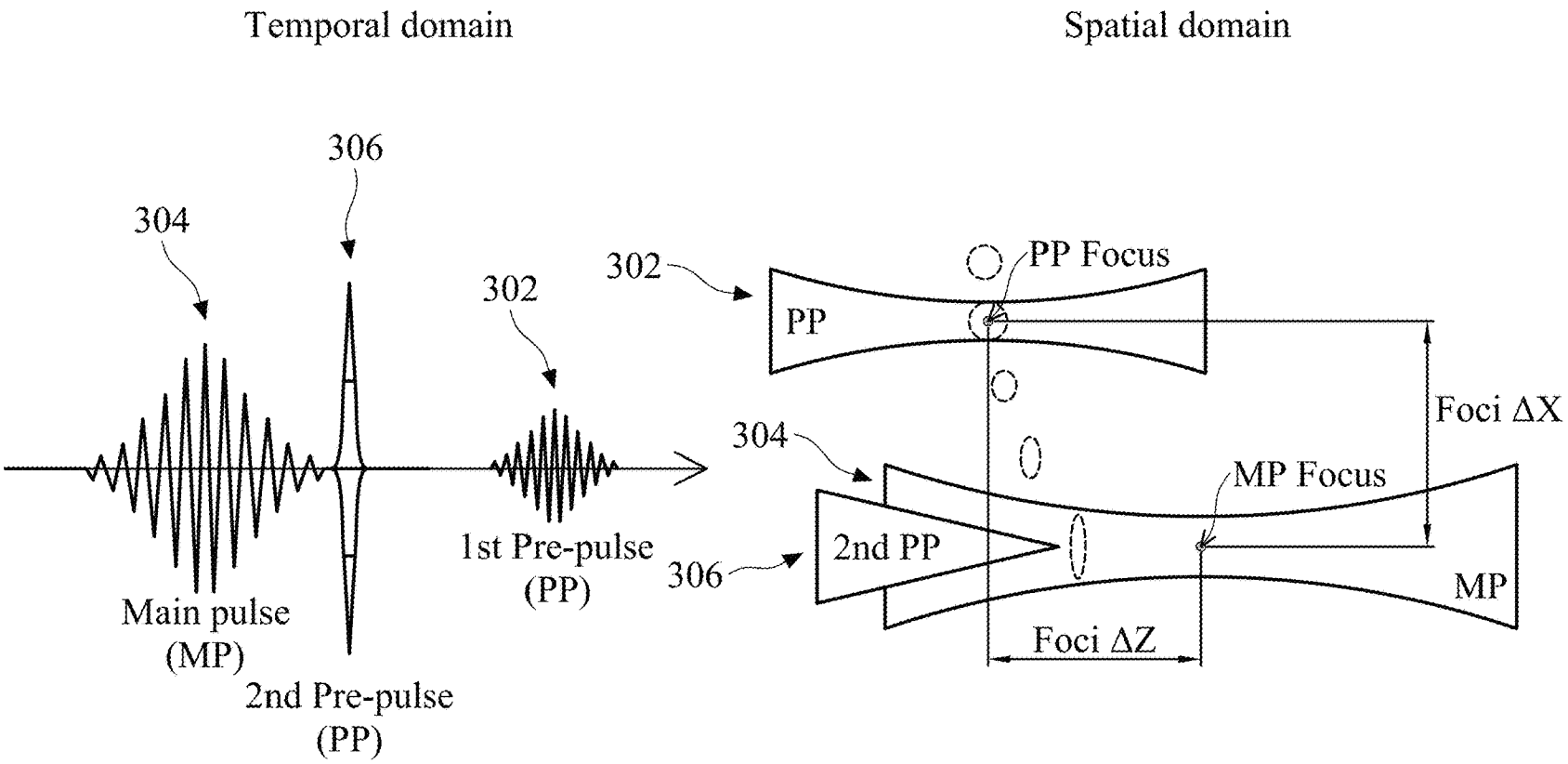
FIG. 3 is a schematic diagram of an exemplary triple pulse scheme in both the temporal domain and the spatial domain, in accordance with some embodiments.

By way of illustration, and with reference to FIG. 3, illustrated therein is a schematic diagram of an exemplary triple pulse scheme in both the temporal domain and the spatial domain, in accordance with various embodiments of the present disclosure. It is noted that the triple pulse scheme of FIG. 3 shares various attributes of the double pulse scheme of FIG. 2, with a notable difference being the addition of the second pre-pulse. Thus, in accordance with various embodiments, the triple pulse scheme disclosed herein includes a first pre-pulse (PP) 302, which may be similar to the pre-pulse 202, and which may similarly be used to re-shape the tin droplets generated by the droplet generator 110. In various embodiments, the triple pulse scheme also includes a separate, main pulse (MP) 304, which in some aspects is similar to the main pulse 204. Additionally, in some embodiments and distinct from the double pulse scheme, the triple pulse scheme includes a second pre-pulse (PP) 306. As discussed above, the second pre-pulse 306 may be implemented between, in the time domain, the first pre-pulse 302 and the main pulse 304. As discussed in more detail below, the second pre-pulse 306 may be used as a plasma igniter and the main pulse 304 may be used as a plasma heater for creating hot and dense plasma and EUV generation. By way of example, the duration of and time delay between each of the first pre-pulse 302, the second pre-pulse 306, and the main pulse 304 may be as previously described.

In contrast to the double pulse scheme, which uses the main pulse for both seed plasma formation and for plasma heating, the triple pulse scheme separates these two functions. For example, the second pre-pulse 306, used as the plasma igniter (e.g., seed plasma formation), may in some cases serve a similar function as the front foot 208 of the main pulse in the double pulse scheme, while the main pulse 304 serves as the plasma heater. By separating the seed plasma formation and the plasma heating functions between the second pre-pulse 306 and the main pulse 304, the triple pulse scheme provides for optimization of the time delay between the plasma igniter (e.g., the second pre-pulse) and the heater (e.g., the main pulse). By way of example, and in some embodiments, the time delay between the second pre-pulse and the main pulse may be between about 10-100 ns. By providing for optimization of this delay time, embodiments of the present disclosure will provide for enhanced conversion efficiency of LPP EUV generation and for source power scaling up by optimizing the plasma heating efficiency. Generally, the triple pulse scheme disclosed herein provides for complete control of the formation of the seed plasma, for example, by providing for control (e.g., tuning) of the power, duration, and delay of the second pre-pulse. It is also noted that in some cases, the second pre-pulse may be implemented as a single pulse or as a pulse train. Also, in various embodiments, each of the first pre-pulse, the second pre-pulse, and the main pulse may be generated by the same or different laser sources. Separately and in addition, by utilizing a plasma igniter (e.g., the second pre-pulse 306) having a very short wavelength (e.g., 257 nm), the ionization rate for seed plasma generation is enhanced, which also provides enhancement/protection against the background ionization driven by residual pedestal of the leading-edge portion of the plasma heater (e.g., main pulse 304) at longer wavelengths (e.g., 10.59 μm). Further, the triple pulse scheme disclosed herein including a plasma igniter (e.g., the second pre-pulse 306) having a very short duration (e.g., within a picosecond-femtosecond range) not only increases laser focal intensity for a higher ionization rate via tunneling ionization instead of multi-photon ionization but also creates a seed plasma with a precise spatiotemporal distribution. In addition, the generated seed plasma may be free from the thermal effect for both laser source and application. Moreover, the disclosed method mitigates the influence on conversion efficiency of EUV generation by shaping the preformed plasma for stable EUV generation, when the main pulse impinges on the mist of tin with various incident angles. In some embodiments, use of the triple pulse scheme described herein may provide a 1.5× to 2× improvement in LPP EUV conversion efficiency. Those skilled in the art will recognize other benefits and advantages of the methods and system as described herein, and the embodiments described are not meant to be limiting beyond what is specifically recited in the claims that follow.

Figure 4:
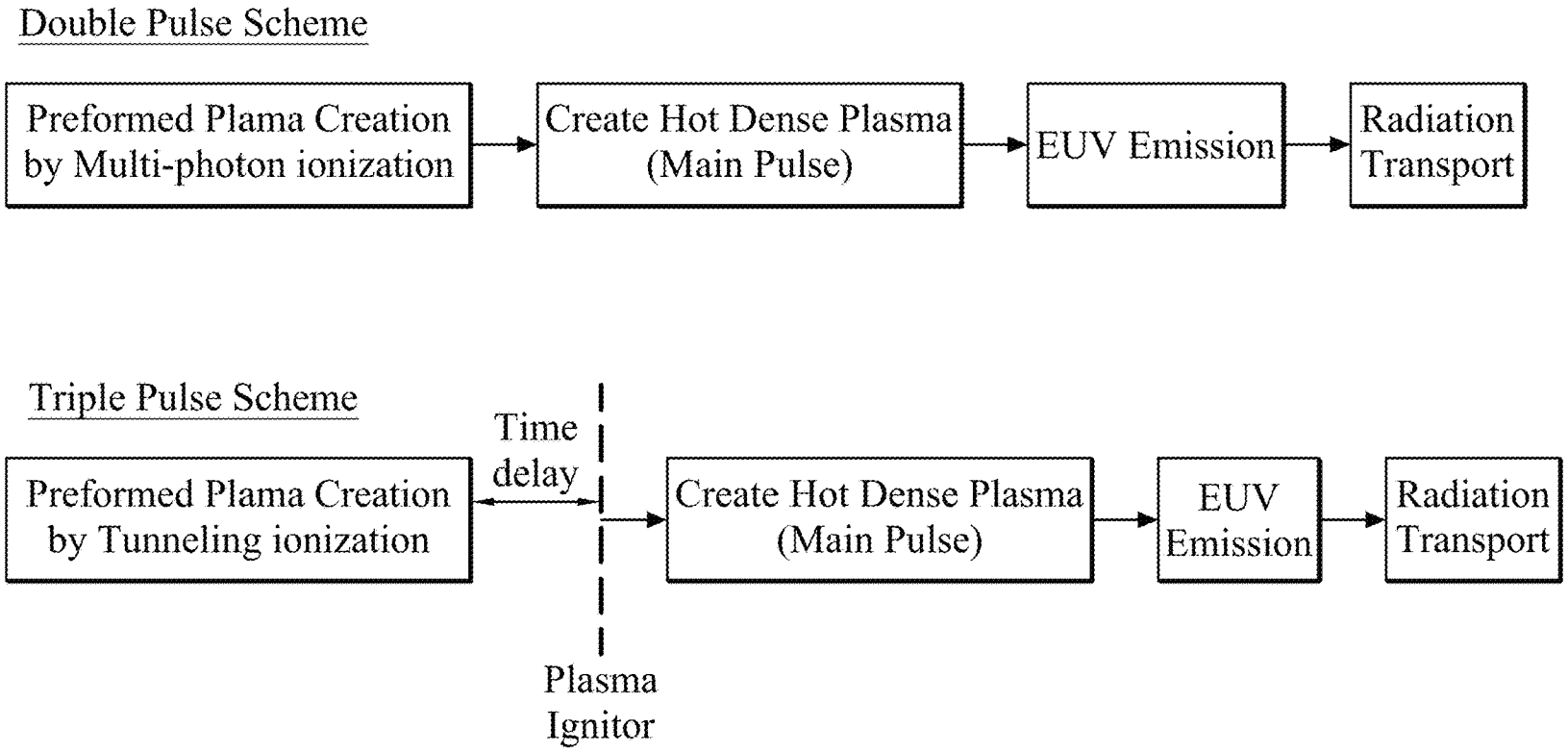
FIG. 4 illustrates a flow that depicts an LPP EUV generation process for a double pulse scheme and a triple pulse scheme, in accordance with some embodiments.
Figure 5A:
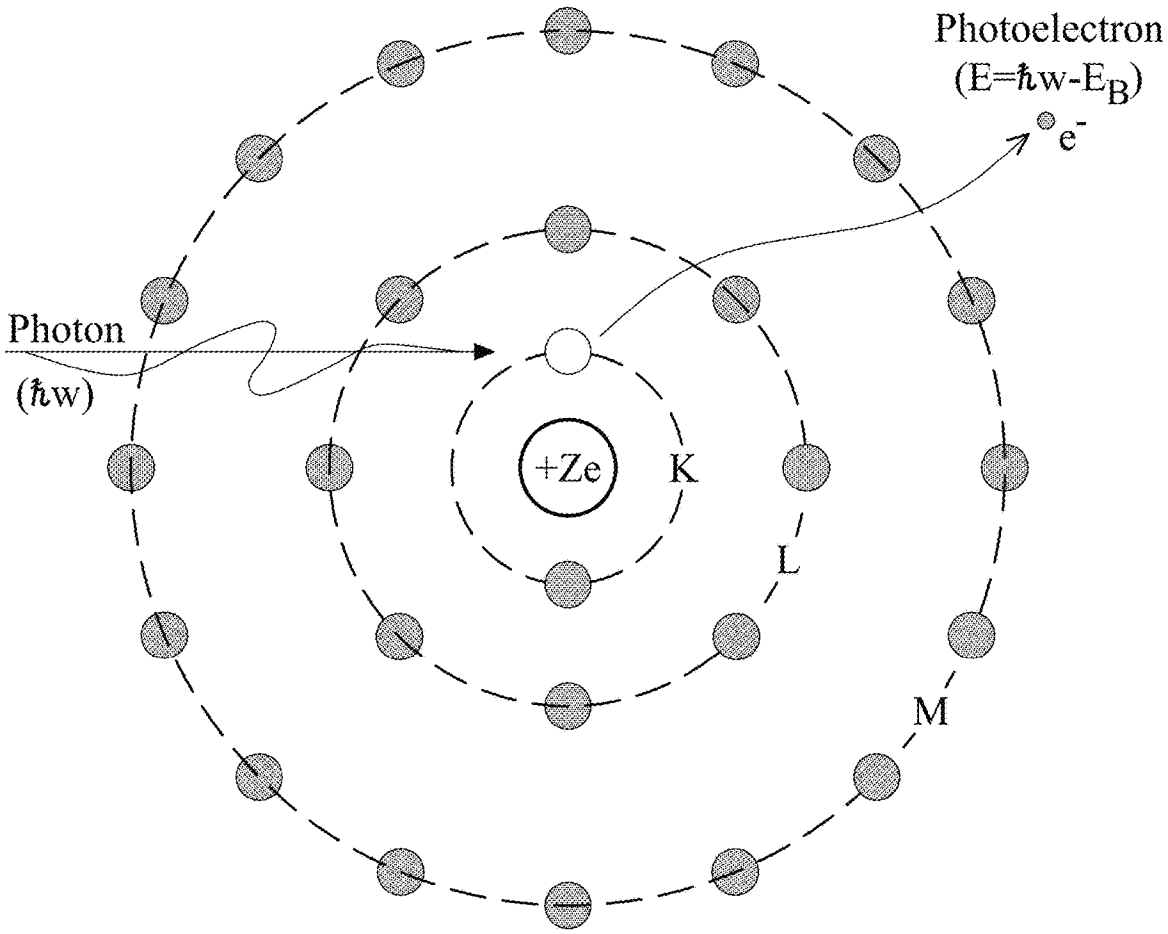
FIGS. 5A and 5B illustrate a depiction of an optical field ionization (OFI) process, in accordance with some embodiments.
Figure 5B:
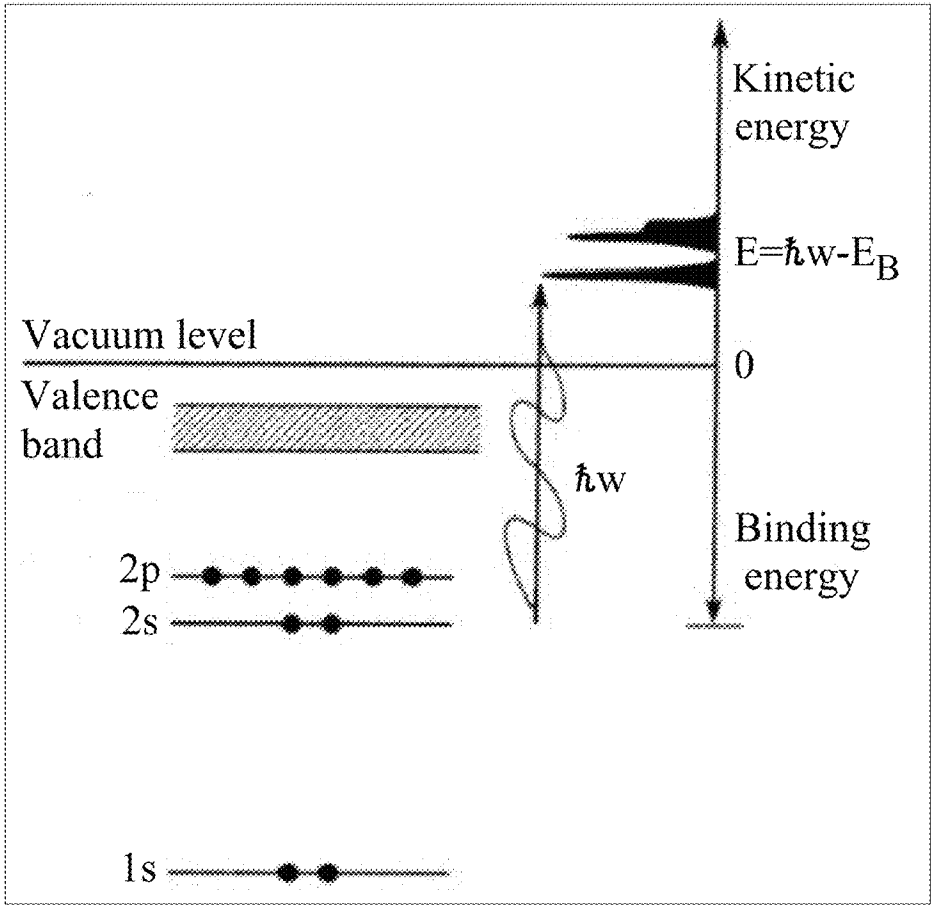
Figure 6:
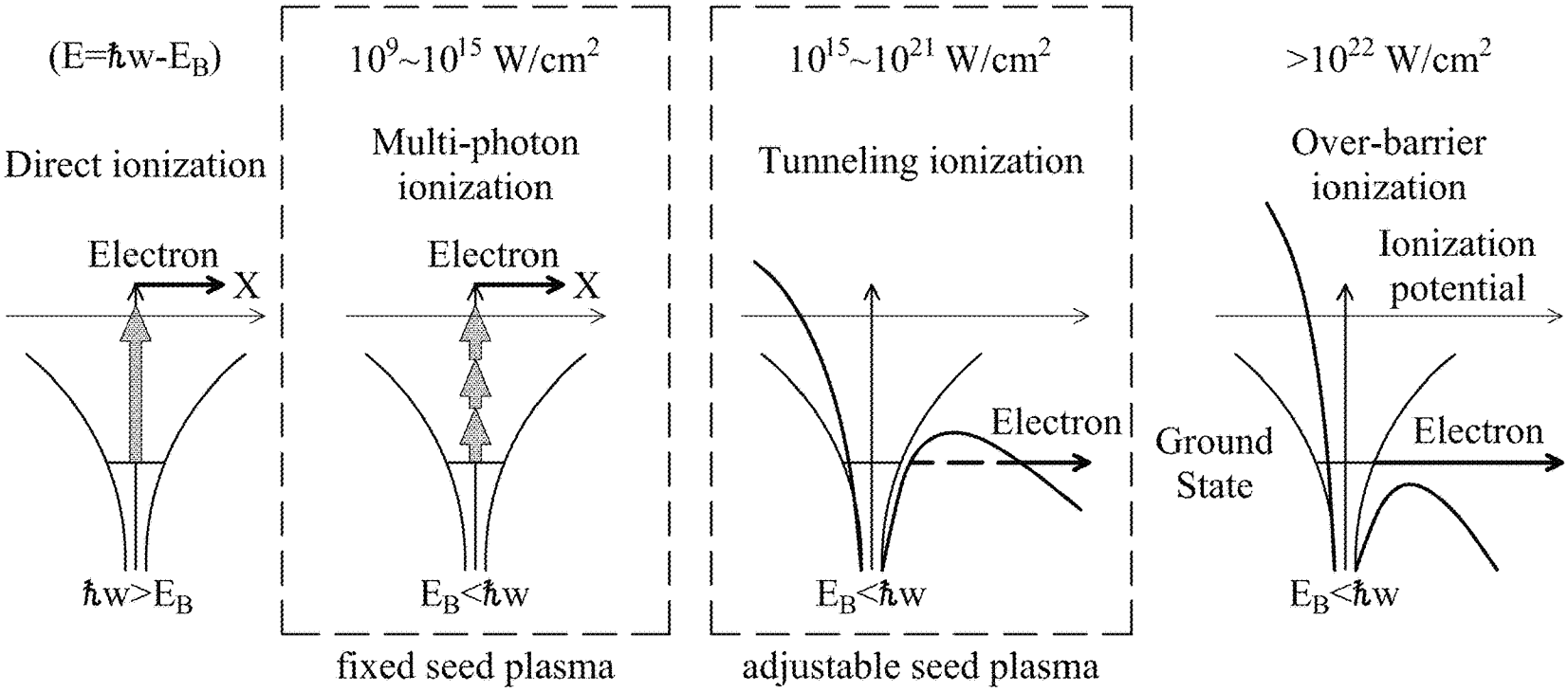
FIG. 6 illustrates an example of ionization processes that may occur during an OFI plasma generation process, according to some embodiments.
Figure 7:
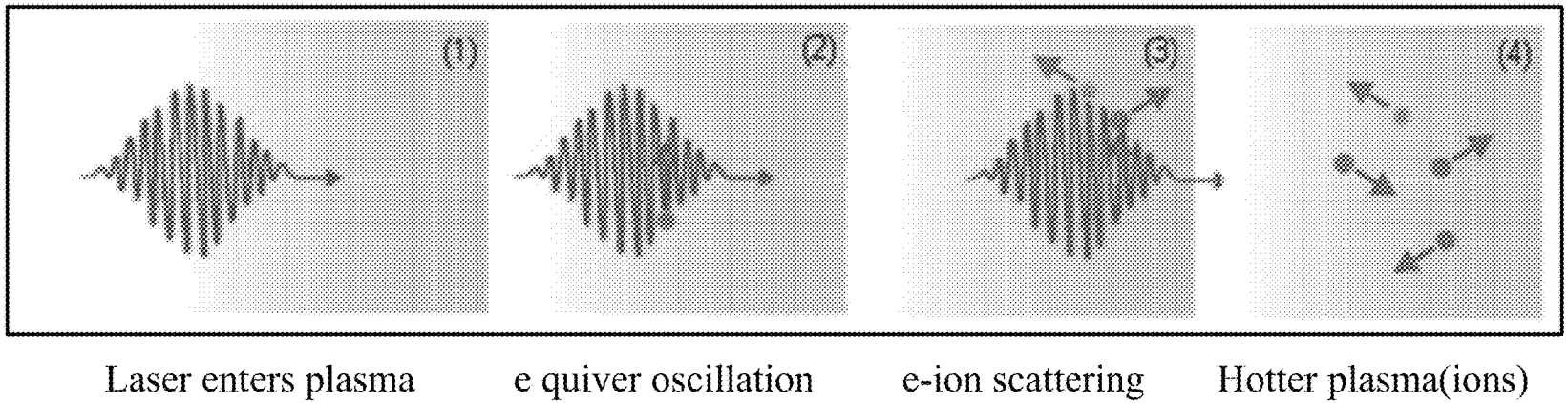
FIG. 7 illustrates a description of the mechanisms occurring during inverse Bremsstrahlung absorption (IBA)

Referring now to FIG. 4, illustrated therein is a flow (e.g., of a method) that depicts a LPP EUV generation process for a double pulse scheme and for a triple pulse scheme, in accordance with some embodiments. FIG. 4 illustratively shows the steps of creating a preformed or seed plasma, creating a hot dense plasma, EUV emission, and radiation transport. In particular, and in accordance with some embodiments, FIG. 4 illustrates a temporal position of the plasma igniter (e.g., the second pre-pulse) used in the triple pulse scheme, as previously described. As noted above, the triple pulse scheme disclosed herein provides for optimization of the time delay between the plasma igniter (e.g., the second pre-pulse) and the heater (e.g., the main pulse, providing for enhanced EUV conversion efficiency. Referring to FIGS. 5A and 5B, illustrated therein is a depiction of an optical field ionization (OFI) process, in accordance with some embodiments. In some cases, direct ionization may occur by a high-intensity laser that provides for electron-ion collision, where the time scale for such a process may be much less than a duration of the laser pulse. In addition, and in various embodiments, the free electron kinetic energy may be equal to the absorbed photon energy (hω) minus the bound electron binding energy ($E_B$). FIG. 6 provides an example of ionization processes that may occur during an OFI plasma generation process. As noted above, existing double pulse schemes may suffer from having a fixed seed plasma driven by the front foot of the main pulse. Alternatively, embodiments disclosed herein provide for an adjustable seed plasma driven by the plasma igniter (e.g., the second pre-pulse). More generally, embodiments disclosed herein provide for complete control of the formation of the preformed plasma (e.g., the seed plasma), for example, by providing the triple pulse scheme and including providing for control (e.g., tuning) of the power, duration, and delay of the second pre-pulse. It is also noted that in some cases, the second pre-pulse may be implemented as a single pulse or as a pulse train. Also, in various embodiments, each of the first pre-pulse, the second pre-pulse, and the main pulse may be generated by the same or different laser sources. Referring to FIG. 7, illustrated therein is a description of the mechanisms occurring during inverse Bremsstrahlung absorption (IBA), as well as the analytical equation of the IBA coefficient ($k_{IB}$), as discussed above. In some embodiments, in an IBA process, a laser may deliver energy to a heavy ion (e.g., to heat the plasma) via electrons by inelastic collisions. In some cases, the IBA process may be more efficient for higher plasma densities, at a lower electron temperature, and at an optical intensity of the laser of about $10^{10}$~$10^{12}$ W/cm$^2$. In various embodiments, the efficiency of plasma heating depends on plasma density and temperature, and the initial condition is the transient spatiotemporal distribution of seed tin plasmas driven by the adjustable plasma igniter (e.g., the second pre-pulse). Thus, embodiments of the present disclosure provide for enhanced plasma seed formation, as well as for enhanced plasma heating efficiency.

Figure 8:
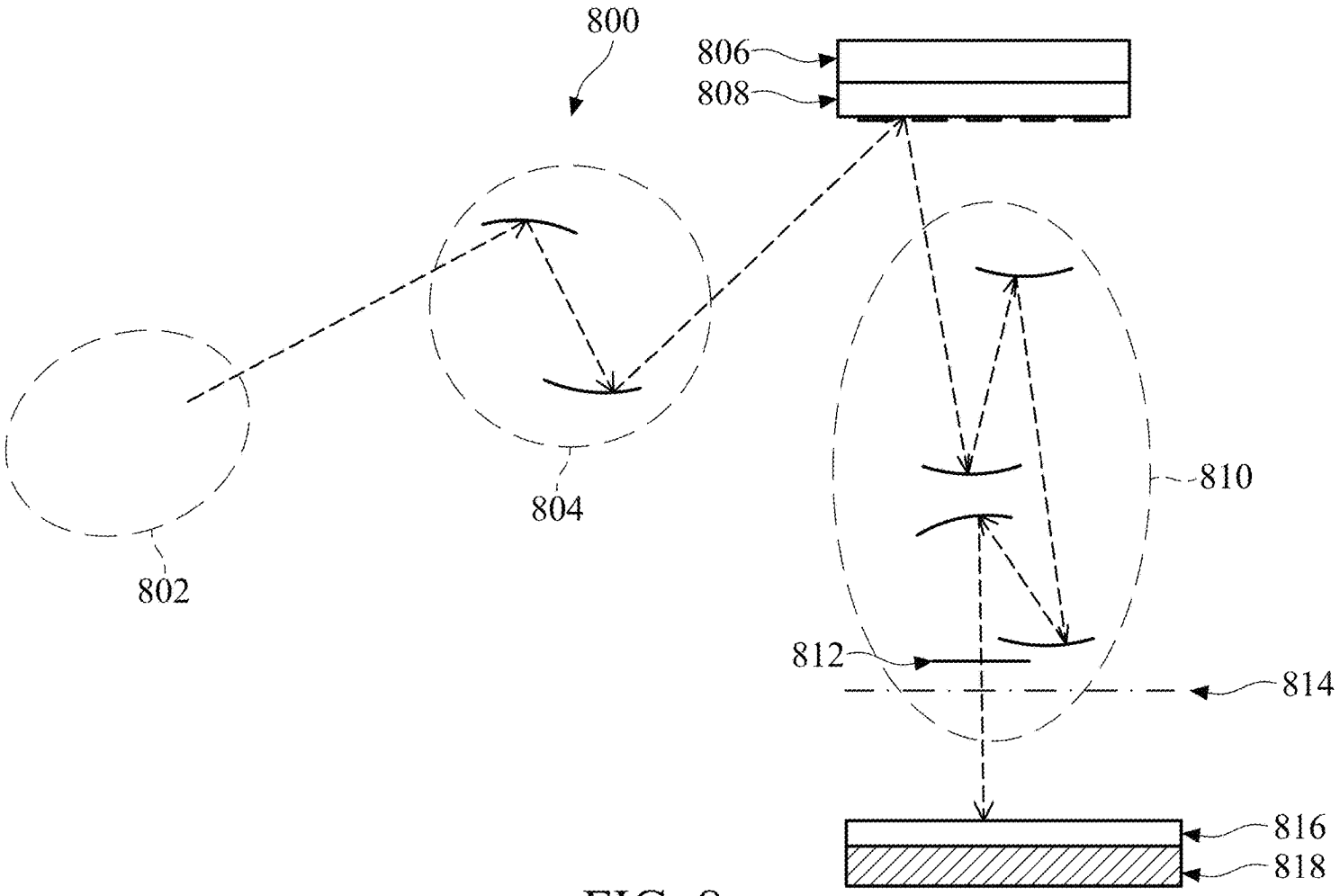
FIG. 8 is a schematic view of a lithography system, in accordance with some embodiments.

As previously noted, the system and methods described above, including the triple pulse scheme, may be used to provide an EUV light source for a lithography system. By way of illustration, and with reference to FIG. 8, provided therein is a schematic view of an exemplary lithography system 800, in accordance with some embodiments. The lithography system 800 may also be generically referred to as a scanner that is operable to perform lithographic processes including exposure with a respective radiation source and in a particular exposure mode. In at least some of the present embodiments, the lithography system 800 includes an extreme ultraviolet (EUV) lithography system designed to expose a resist layer by EUV light (e.g., provided via the EUV vessel). Inasmuch, in various embodiments, the resist layer includes a material sensitive to the EUV light (e.g., an EUV resist). The lithography system 800 of FIG. 8 includes a plurality of subsystems such as a radiation source 802 (e.g., such as the EUV light source 100 of FIG. 1), an illuminator 804, a mask stage 806 configured to receive a mask 808, projection optics 810, and a substrate stage 818 configured to receive a semiconductor substrate 816. A general description of the operation of the lithography system 800 may be given as follows: EUV light from the radiation source 802 is directed toward the illuminator 804 (which includes a set of reflective mirrors) and projected onto the reflective mask 808. A reflected mask image is directed toward the projection optics 810, which focuses the EUV light and projects the EUV light onto the semiconductor substrate 816 to expose an EUV resist layer deposited thereupon. Additionally, in various examples, each subsystem of the lithography system 800 may be housed in, and thus operate within, a high-vacuum environment, for example, to reduce atmospheric absorption of EUV light.

In the embodiments described herein, the radiation source 802 may be used to generate the EUV light. In some embodiments, the radiation source 802 includes a plasma source, such as for example, a discharge produced plasma (DPP) or a laser produced plasma (LPP). In some examples, the EUV light may include light having a wavelength ranging from about 1 nm to about 100 nm. In one particular example, the radiation source 802 generates EUV light with a wavelength centered at about 13.5 nm. Accordingly, the radiation source 802 may also be referred to as an EUV radiation source 802. In some embodiments, the radiation source 802 also includes a collector, which may be used to collect EUV light generated from the plasma source and to direct the EUV light toward imaging optics such as the illuminator 804.

As described above, light from the radiation source 802 is directed toward the illuminator 804. In some embodiments, the illuminator 804 may include reflective optics (e.g., for the EUV lithography system 800), such as a single mirror or a mirror system having multiple mirrors in order to direct light from the radiation source 802 onto the mask stage 806, and particularly to the mask 808 secured on the mask stage 806. In some examples, the illuminator 804 may include a zone plate, for example, to improve focus of the EUV light. In some embodiments, the illuminator 804 may be configured to shape the EUV light passing therethrough in accordance with a particular pupil shape, and including for example, a dipole shape, a quadrapole shape, an annular shape, a single beam shape, a multiple beam shape, and/or a combination thereof. In some embodiments, the illuminator 804 is operable to configure the mirrors (i.e., of the illuminator 804) to provide a desired illumination to the mask 808. In one example, the mirrors of the illuminator 804 are configurable to reflect EUV light to different illumination positions. In some embodiments, a stage prior to the illuminator 804 may additionally include other configurable mirrors that may be used to direct the EUV light to different illumination positions within the mirrors of the illuminator 804. In some embodiments, the illuminator 804 is configured to provide an on-axis illumination (ONI) to the mask 808. In some embodiments, the illuminator 804 is configured to provide an off-axis illumination (OAI) to the mask 808. It should be noted that the optics employed in the EUV lithography system 800, and in particular optics used for the illuminator 804 and the projection optics 810, may include mirrors having multilayer thin-film coatings known as Bragg reflectors. By way of example, such a multilayer thin-film coating may include alternating layers of Mo and Si, which provides for high reflectivity at EUV wavelengths (e.g., about 13 nm).

As discussed above, the lithography system 800 also includes the mask stage 806 configured to secure the mask 808. Since the lithography system 800 may be housed in, and thus operate within, a high-vacuum environment, the mask stage 806 may include an electrostatic chuck (e-chuck) to secure the mask 808. As with the optics of the EUV lithography system 800, the mask 808 is also reflective. As illustrated in the example of FIG. 8, light is reflected from the mask 808 and directed towards the projection optics 810, which collects the EUV light reflected from the mask 808.

By way of example, the EUV light collected by the projection optics 810 (reflected from the mask 808) carries an image of the pattern defined by the mask 808. In various embodiments, the projection optics 810 provides for imaging the pattern of the mask 808 onto the semiconductor substrate 816 secured on the substrate stage 818 of the lithography system 800. In particular, in various embodiments, the projection optics 810 focuses the collected EUV light and projects the EUV light onto the semiconductor substrate 816 to expose an EUV resist layer deposited on the semiconductor substrate 816. As described above, the projection optics 810 may include reflective optics, as used in EUV lithography systems such as the lithography system 800. In some embodiments, the illuminator 804 and the projection optics 810 are collectively referred to as an optical module of the lithography system 800.

In some embodiments, the lithography system 800 also includes a pupil phase modulator 812 to modulate an optical phase of the EUV light directed from the mask 808, such that the light has a phase distribution along a projection pupil plane 814. In some embodiments, the pupil phase modulator 812 includes a mechanism to tune the reflective mirrors of the projection optics 810 for phase modulation. For example, in some embodiments, the mirrors of the projection optics 810 are configurable to reflect the EUV light through the pupil phase modulator 812, thereby modulating the phase of the light through the projection optics 810. In some embodiments, the pupil phase modulator 812 utilizes a pupil filter placed on the projection pupil plane 814. By way of example, the pupil filter may be employed to filter out specific spatial frequency components of the EUV light reflected from the mask 808. In some embodiments, the pupil filter may serve as a phase pupil filter that modulates the phase distribution of the light directed through the projection optics 810.

As discussed above, the lithography system 800 also includes the substrate stage 818 to secure the semiconductor substrate 816 to be patterned. In various embodiments, the semiconductor substrate 816 includes a semiconductor wafer, such as a silicon wafer, germanium wafer, silicon-germanium wafer, III-V wafer, or other type of wafer as described above or as known in the art. The semiconductor substrate 816 may be coated with a resist layer (e.g., an EUV resist layer) sensitive to EUV light. EUV resists may have stringent performance standards. For purposes of illustration, an EUV resist may be designed to provide at least around 22 nm resolution, at least around 2 nm line-width roughness (LWR), and with a sensitivity of at least around 15 mJ/cm$^2$. In the embodiments described herein, the various subsystems of the lithography system 800, including those described above, are integrated and are operable to perform lithography exposing processes including EUV lithography processes. To be sure, the lithography system 800 may further include other modules or subsystems which may be integrated with (or be coupled to) one or more of the subsystems or components described herein.

The various embodiments described herein offer several advantages over the existing art. It will be understood that not all advantages have been necessarily discussed herein, no particular advantage is required for all embodiments, and other embodiments may offer different advantages. For example, embodiments discussed herein provide a triple pulse scheme that includes a first pre-pulse beam, a second pre-pulse beam, and a main pulse. In various embodiments, the second pre-pulse is designed to be implemented between, in the time domain, the pre-pulse and the main pulse. In various embodiments, the second pre-pulse may be used as a plasma igniter and the main pulse may be used as a plasma heater for creating a hot and dense plasma and for EUV generation. By separating the seed plasma formation and the plasma heating functions between the second pre-pulse and the main pulse, the disclosed triple pulse scheme provides for optimization of the time delay between the plasma igniter (e.g., the second pre-pulse) and the heater (e.g., the main pulse). Further, by providing for optimization of this delay time, embodiments of the present disclosure will provide for enhanced conversion efficiency of LPP EUV generation and for optimizing the plasma heating efficiency. Moreover, the triple pulse scheme disclosed herein generally provides for complete control of the formation of the seed plasma, for example, by providing for control (e.g., tuning) of the power, duration, and delay of the second pre-pulse. Thus, embodiments of the present disclosure serve to overcome various shortcomings of at least some existing EUV light generation techniques.

Thus, one of the embodiments of the present disclosure described a method that includes irradiating a droplet within an extreme ultraviolet (EUV) vessel using a first pre-pulse laser beam to form a re-shaped droplet. In various embodiments, a seed plasma is then formed by irradiating the re-shaped droplet using a second pre-pulse laser beam. Thereafter, and in some cases, the seed plasma is heated by irradiating the seed plasma using a main pulse laser beam to generate EUV light.

In another of the embodiments, discussed is a method where a plasma is ignited within an extreme ultraviolet (EUV) vessel by irradiating a target within the EUV vessel using first laser pulse having a first wavelength. In various examples, after irradiating the target using the first laser pulse and after a first delay time, the plasma is heated by irradiating the plasma using a second laser pulse having a second wavelength longer than the first wavelength. In some embodiments, EUV light is generated by the heated plasma.

In yet another of the embodiments, discussed is an extreme ultraviolet (EUV) light source including a laser source configured to generate a first pre-pulse laser beam, a second pre-pulse laser beam, and a main pulse laser beam. In various embodiments, the EUV light source further includes an EUV vessel having a droplet generator that provides a tin droplet within the EUV vessel. Additionally, in some embodiments, the EUV light source includes a collector having a first focus at an irradiation region within the EUV vessel and a second focus at an intermediate focus region. By way of example, the EUV light source may be configured to irradiate the tin droplet at the irradiation region within the EUV vessel using the first pre-pulse laser beam to form a re-shaped droplet. In some cases, the EUV light source may be configured to irradiate the re-shaped droplet using the second pre-pulse laser beam to form a seed plasma. Thereafter, in some embodiments, the EUV light source may be configured to heat the seed plasma using the main pulse laser beam to generate EUV light that is output from the EUV vessel through the intermediate focus region.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method, comprising:

irradiating a droplet within an extreme ultraviolet (EUV) vessel using a first pre-pulse laser beam to form a re-shaped droplet, wherein the droplet is irradiated at a focal point of the first pre-pulse laser beam;

forming a seed plasma by irradiating the re-shaped droplet using a second pre-pulse laser beam, wherein the re-shaped droplet is irradiated at a focal point of the second pre-pulse laser beam; and heating the seed plasma by irradiating the seed plasma using a main pulse laser beam to generate EUV light, wherein a diameter of the focal point of the second pre-pulse laser beam is less than a diameter of the focal point of the first pre-pulse laser beam.

2. The method of claim 1, wherein the droplet includes a tin droplet.

3. The method of claim 1, wherein the re-shaped droplet includes a disk, a dome, a cloud, or a mist.

4. The method of claim 1, wherein a time delay between the second pre-pulse laser beam and the main pulse laser beam is between about 10 and 100 nanoseconds.

5. The method of claim 1, wherein the second pre-pulse laser beam has a first wavelength, and wherein the main pulse has a second wavelength longer than the first wavelength.

6. The method of claim 5, wherein the first wavelength is equal to or less than 257 nanometers, and wherein the second wavelength is equal to or greater than 1.064 microns or 10.59 microns.

7. The method of claim 1, wherein a duration of the second pre-pulse laser beam is within a femtosecond to picosecond range.

8. The method of claim 1, wherein the second pre-pulse laser beam ignites a plasma to form the seed plasma.

9. The method of claim 1, wherein the second pre-pulse laser beam is implemented as one of a single pulse and a pulse train.

10. The method of claim 1, wherein formation of the seed plasma is controlled by tuning at least one of a power, a duration, and a delay of the second pre-pulse laser beam.

11. The method of claim 1, wherein each of the first pre-pulse laser beam, the second pre-pulse laser beam, and the main pulse laser beam are generated by the same or different laser sources.

12. A method, comprising:

igniting a plasma within an extreme ultraviolet (EUV) vessel by irradiating a target within the EUV vessel using first laser pulse having a first wavelength and a first application intensity;

after irradiating the target using the first laser pulse and after a first delay time, heating the plasma by irradiating the plasma using a second laser pulse having a second wavelength and a second application intensity, wherein the second wavelength is longer than the first wavelength, and wherein the first application intensity is greater than the second application intensity;

generating EUV light by the heated plasma;

prior to igniting the plasma, irradiating the target with a third laser pulse having a third application intensity to re-shape the target, wherein the third application intensity is less than the second application intensity; and after re-shaping the target and after a second delay time greater than the first delay time, igniting the plasma.

13. The method of claim 12, wherein the target includes a tin droplet.

14. The method of claim 12, wherein the first delay time is between about 10 and 100 nanoseconds.

15. The method of claim 12, wherein the first wavelength is about 257 nanometers, wherein the second wavelength is about 10.59 microns.

16. The method of claim 12, wherein the first wavelength is about 257 nm wavelength, and wherein a duration of the first laser pulse is within a femtosecond to picosecond range.

17. An extreme ultraviolet (EUV) light source, comprising:

a laser source configured to generate a first pre-pulse laser beam, a second pre-pulse laser beam, and a main pulse laser beam;

an EUV vessel including a droplet generator that provides a tin droplet within the EUV vessel; and a collector having a first focus at an irradiation region within the EUV vessel and a second focus at an intermediate focus region;

wherein the EUV light source is configured to irradiate the tin droplet at the irradiation region within the EUV vessel using the first pre-pulse laser beam having a first application intensity to form a re-shaped droplet;

wherein the EUV light source is configured to irradiate the re-shaped droplet using the second pre-pulse laser beam having a second application intensity greater than the first application intensity to form a seed plasma; and wherein the EUV light source is configured to heat the seed plasma using the main pulse laser beam having a third application intensity less than the second application intensity to generate EUV light that is output from the EUV vessel through the intermediate focus region.

18. The EUV light source of claim 17, wherein a time delay between the second pre-pulse laser beam and the main pulse laser beam is between about 10 and 100 nanoseconds.

19. The EUV light source of claim 17, wherein the second pre-pulse laser beam has a first wavelength, and wherein the main pulse has a second wavelength longer than the first wavelength.

20. The EUV light source of claim 17, wherein the laser source includes a plurality of laser sources.

* * * * *